United States Patent [19]

Harada

[11] Patent Number: 4,776,711

[45] Date of Patent: Oct. 11, 1988

[54] BOOKLET PRINTER

[75] Inventor: Mineo Harada, Owariasahi, Japan

[73] Assignee: Hitachi, Ltd., Tokyo, Japan

[21] Appl. No.: 878,825

[22] Filed: Jun. 26, 1986

[30] Foreign Application Priority Data

Jun. 28, 1985 [JP] Japan ..... 60-140341

[51] Int. Cl.[4] ..... B41J 3/28

[52] U.S. Cl. ..... 400/24; 400/26; 400/27; 400/82

[58] Field of Search ..... 400/23, 24, 25, 26, 400/27, 28, 44, 45, 48, 82, 120, 649, 652

[56] References Cited

U.S. PATENT DOCUMENTS

| | | | |
|---|---|---|---|
| 3,361,243 | 1/1968 | Kaiser | 400/28 |
| 4,204,779 | 5/1980 | Lee et al. | 400/82 |
| 4,483,633 | 11/1984 | Kosner, Jr. et al. | 400/82 |

FOREIGN PATENT DOCUMENTS

| | | | |
|---|---|---|---|
| 3032858 | 3/1981 | Fed. Rep. of Germany | 400/120 |
| 5775 | 1/1981 | Japan | 400/82 |
| 134770 | 8/1983 | Japan | 400/28 |
| 39563 | 3/1984 | Japan | 400/120 |

OTHER PUBLICATIONS

P. Delapchier et al.; "Pass Book for Disk Printer"; *IBM Technical Disclosure Bulletin;* vol. 13, No. 8, p. 2350; Jan. 1971.

*Primary Examiner*—David A. Wiecking

*Attorney, Agent, or Firm*—Fay, Sharpe, Beall, Fagan, Minnich & McKee

[57] ABSTRACT

Two print heads each having a plurality of print elements arranged over a print width to allow printing of a predetermined area by a print scan operation are arranged one for each one of adjacent pages bordered by a seam line of a booklet along which a plurality of sheets of the booklet are bound. The print elements are non-impact type print elements such as thermal print elements.

11 Claims, 5 Drawing Sheets

BOOKLET PRINTER

BACKGROUND OF THE INVENTION

The present invention relates to a printer capable of printing on a booklet such as a passbook having a plurality of sheets bound, and more particularly to a booklet printer suitable as a passbook printer which uses a non-impact printing system such as a thermal printing system.

In a printer for printing characters on a booklet such as passbook having a plurality of sheets bound, a wire dot printing system has been mainly used. For example, in Japanese Patent Examined Publication No. 59-15833, a passbook whose thickness differs depending on which page is being printed is pressed to a reference guide by a platen to keep a print plane at a constant position, and characters are printed by wire dot print means. This apparatus can make sharp print on a print medium having a variable thickness, but when the passbook is to be line-fed, the pressure to the passbook must be temporarily released. As a result, the operation time increases and it is an obstacle to improved printing performance.

Further, because of the wire dot printing system, the print noise is loud.

In order to resolve the print noise problem, it has been proposed to use a thermal print system. An example thereof is disclosed in Japanese Patent Unexamined Publication No. 56-34465. In this apparatus, a thermal print head is moved along a line to print characters on one line. When the passbook is to be line-fed after printing, it is necessary to release pressure to the thermal print head. As a result, it is difficult to improve printing performance as it is in the wire dot printing system.

A print system which does not need release of pressure to the thermal print head where the sheet is to be line-fed is shown in FIG. 1, in which a planar line dot type thermal print head 1 has heat generating resistors 2 corresponding to print elements, conductors 4, a driver 5 and a connector plannerly arranged on a substrate 3. As shown in FIG. 2, the thermal print head 1 is pressed by a spring 10 to a thermal carbon paper 7 on a platen roller 9. This apparatus has been known as a line dot type thermal printer.

In the print operation, the heat generating resistors of the thermal print head (thermal head) 1 are pressed to the thermal carbon paper 7 having thermally fusable ink applied thereon while a print sheet 8 is pressed to the platen roller 9 by the spring 10. The print sheet is fed by rotating the platen roller 9 to feed the print sheet 8 and the thermal carbon paper 7 together. Since it is not necessary to release the pressure to the thermal head when the print sheet is to be line-fed, a high speed print operation is attained.

However, when this print system is applied to a printer which prints characters near a seam area (folding line 12) of the passbook 11 having a plurality of sheets bound as shown in FIG. 3, the following problem arises.

The thickness of the passbook significantly changes around the folding line 12 and there is a large step at the folding line 12. In a passbook shown in FIG. 4, print lines 13*a* and 13*b* adjacent the folding line are usually spaced from the folding line by approximately 5 mm. The step between a first page 14 and an adjacent page 15 bordered by the folding line with the passbook 11 being in an open position may exceed 1.5 mm, although it differs depending on the particular page being printed on. Accordingly, when characters are to be printed by the known line dot type thermal printer as shown in FIG. 3 on print lines near the folding line 12 of the passbook the heat generating resistors 12 do not contact the thermal carbon paper 7 and the passbook 11 unless the passbook is pressed to the thermal head 1 with a very high pressure. Since the passbook usually has a thick sheet as a front sheet 16, the pressure required is necessarily high. If the platen roller 9 is rotated while the passbook and the thermal carbon paper are pressed with such high pressure, the print sheet 17 of the passbook (which is usually a relatively thin sheet) is staggered and warps as shown in FIG. 5. As for the thermal carbon paper 7, it usually has a film several microns thick as a base. If it is fed while the high pressure is applied thereto, creases are formed, and when the crease area comes to the print position, the film does not contact the passbook and characters are not printed. In order to resolve these problems, the pressure to the thermal head may be somewhat reduced, but since the contact between the thermal carbon paper and the thermal head is degraded, the characters printed are not sharp. In order to resolve this problem, an application time of pulses to the heat generating resistors of the thermal head may be lengthened to supply greater print energy. In this case, however, the print speed is reduced and the desired high speed printing is not attained.

In order to improve the contact between the passbook and the thermal head around the folding line of the passbook, it is necessary to press the thermal head to the passbook without significantly bending the passbook. As an approach thereto, an end surface type thermal head disclosed in Japanese Patent Unexamined Publication Nos. 60-24963 and 60-24965 and Japanese Utility Model Unexamined Publication No. 59-59342 may be used. A thickness of the end surface type thermal head is several mm. Thus, when characters are printed on the print lines around the folding line of the passbook, the thermal head does not abut against the step of the passbook.

However, the end surface type thermal head is more complex to manufacture and more expensive in manufacturing cost than the planar thermal head shown in FIG. 1. As a result, it is difficult to provide a low cost printer.

SUMMARY OF THE INVENTION

It is an object of the present invention to provide a printer which prints characters by a contact type print head on a booklet having a folding line such as a passbook whose thickness varies depending on the page being printed on and in which the print head must pass through a step caused by a difference in thickness of pages on opposite sides of the folding line.

It is a specific object of the present invention to provide a low cost printer for a passbook which uses a relatively low cost print head such as a planar thermal head.

In accordance with the printer of the present invention, separate print heads are used for printing each different thickness stack of pages on opposite sides of the folding line. The step of the booklet such as the folding line of the passbook, is prevented from approaching or contacting the print head so that good contact between the sheets of the passbook and the print heads are attained with a relatively low pressure.

DESCRIPTION OF THE PREFERRED EMBODIMENTS

Figure 1:
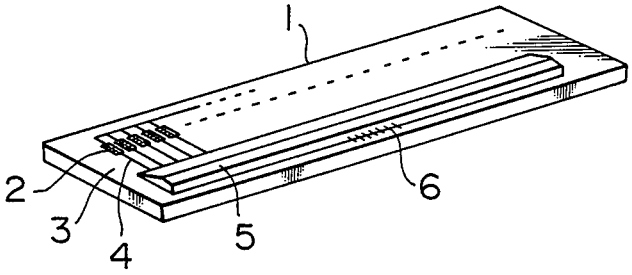
FIG. 1 is a perspective view of a planar thermal head used in one embodiment of the present invention.
Figure 2:
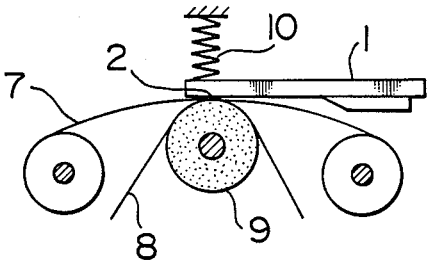
FIG. 2 PRIOR ART
FIG. 2 is a sectional view of an prior art line dot type thermal printer.
Figure 3:
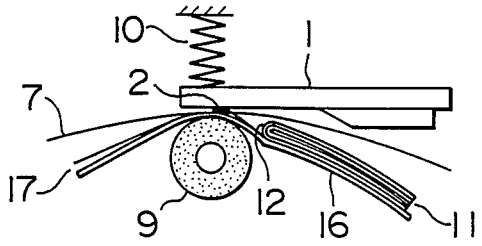
FIG. 3 PRIOR ART
FIG. 3 is a sectional view of a passbook printed by the prior art line dot type thermal printer.
Figure 4:
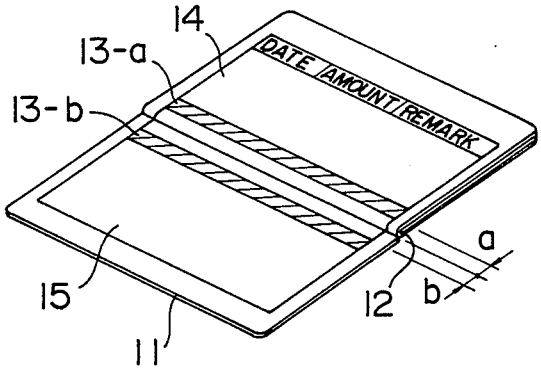
FIG. 4 is a perspective view of a horizontal fold type passbook.
Figure 5:
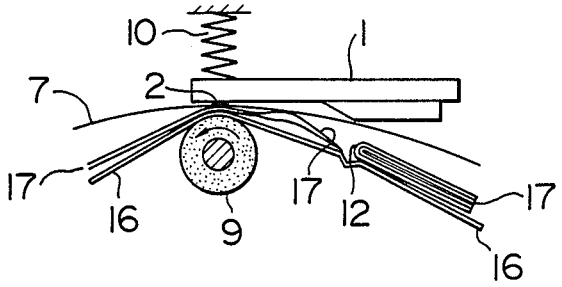
FIG. 5 PRIOR ART
FIG. 5 is a sectional view for illustrating a problem encountered when characters are printed on the passbook by the prior art line dot type thermal printer.
Figure 6:
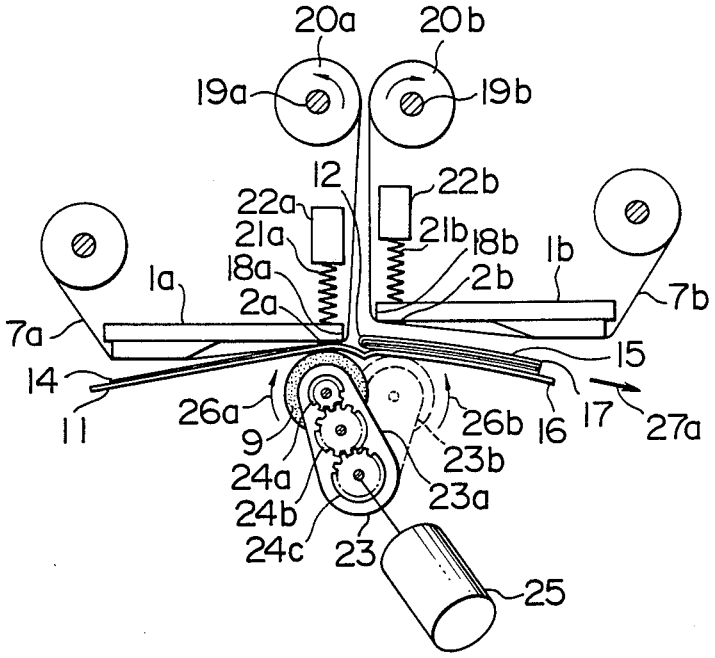
FIG. 6 is a sectional view for illustrating passbook printing in one embodiment of the present invention.

Referring to FIG. 6 which shows a sectional view of one embodiment of the present invention, the embodiment is explained. Two thermal heads 1*a* and 1*b* which are planar thermal heads as shown in FIG. 1 are used. Heat generating resistors 2*a* and 2*b* on the thermal heads 1*a* and 1*b* are positioned within 4 mm from respective ends 18*a* and 18*b*. This size can be readily attained in the manufacture of the planar thermal head. The two thermal heads 1*a* and 1*b* are arranged to face each other at positions which allow the heat generating resistors 2*a* and 2*b* to print characters on the last print line 13*a* of a first page 14 shown in FIG. 4 and the first print line 13*b* of an adjacent page 15, respectively. A spacing between the heat generating resistors 2*a* and 2*b* is approximately 10 mm for a conventional horizontal fold type passbook. This size can be readily attained by the planar thermal heads. Thermal carbon papers 7*a* and 7*b* are arranged one for each of the thermal heads 1*a* and 1*b*. The used thermal carbon papers 7*a* and 7*b* are taken up by independently operable take-up rolls 19*a* and 19*b* in directions 20*a* and 20*b*, respectively. (Drive means for the take-up rolls such as motors are omitted from the drawing.)

Independent pressing springs 21*a* and 21*b* are attached to the thermal heads 1*a* and 1*b*, respectively, and pressure ON/OFF mechanisms 22*a* and 22*b* for applying and releasing the pressures are linked thereto. (The pressure ON/OFF mechanisms may be solenoids, although they are omitted from the drawing.) A platen roller 9 is made of a low hardness elastic material and coupled to a drive motor 25 through drive gears 24*a*, 24*b* and 24*c* arranged on a switch arm 23. The switch arm 23 is switched to one of two positions 23*a* and 23*b* by switch means such as a cam mechanism (not shown). Those positions correspond to the position at which the platen roller 9 faces the heat generating resistors 2*a* and 2*b* of the thermal heads 1*a* and 1*b*. The passbook 11 is pinched between the platen roller 9 and one of the thermal heads 1*a* and 1*b* with one of the thermal carbon papers 7*a* and 7*b* being interposed therebetween.

The operation of the present embodiment is explained. As the pressure ON/OFF mechanisms 22*a* and 22*b* release the pressures to create clearances between the thermal heads 1*a* and 1*b* and the platen roller 9, the passbook 11 is fed to an initial print position. The feed means for the passbook may be a roller mechanism, although it is omitted from the drawing. When the thermal head 1*a* or 1*b* is passed to the passbook 11 at the initial print position, characters can be printed on the last print line 13*a* of page 14 of the passbook 11 or on the first print line 13*b* of the adjacent page. When characters are to be printed on page 14, the switch arm 23 is positioned to a solid line position 23*a* so that the thermal head 1*a* faces the platen roller 9. Then, the pressure ON/OFF mechanism 22*a* is activated to press the thermal head 1*a* to page 14 of the passbook 11. Under this position, the drive motor 25 is rotated to rotate the platen roller 9 in a direction 26*a* and the heat generating resistor 2*a* of the thermal head 1*a* is energized. As a result, thermally fusable ink on the thermal carbon paper 7*a* is fused and transferred onto the passbook 11 to print characters. This print process is similar to that of a well known thermal transfer type printer.

As described above, the heat generating resistor 2*a* of the thermal head 1*a* is located within 4 mm from the edge, and the last print line 13*a* of page 14 is located approximately 5 mm from the folding line 12 of the passbook 11. Accordingly, when the thermal head 1*a* is pressed to the passbook 11, it does not contact the folding line 12 of the passbook 11.

As a result, as shown in FIG. 6, the passbook 11 need not be substantially bent and the heat generating resistor 2*a* of the thermal head 1*a* can contact thermal carbon paper 7*a* and the passbook 11 even with a relatively low pressure. Accordingly, a high print quality is attained. The passbook 11 is fed in a scanning direction indicated by arrow 27*a* by the rotation of the platen roller 9. Hence, page 14 is printed by printing the booklet in only one scanning direction during a printing operation. The print sheets 17 and the front sheet 16 of the passbook 11 are bound along the folding line 12. Since the binding area on the folding line 12 prevents staggering between the print sheet 17 and the front sheet 16, the print sheet 17 does not warp during the feed operation of the passbook 11 and a high print quality is attained. Since the pressure to the thermal head 1*a* may be relatively low as described above, creases are not created in the thermal carbon paper 7*a* and a high print quality is attained. When characters are to be printed on page 15 after the characters have been printed on page 14 of the passbook 11, the pressure ON/OFF mechanism 22*a* releases the pressure and the passbook 11 is returned to the initial print position and the switch arm 23 is switched to a broken line position 23*b*. Then, the pressure ON/OFF mechanism 22*b* is activated to drive the thermal head 1*b* to the print position. The subsequent operation is similar to that described above. The platen roller 9 is rotated in the opposite direction 26*b*.

The print speed or the print performance is described below. The print speed of the present embodiment is compared with that of the prior art wire dot printer for the passbook having 60 print characters per line and a print line spacing of 5 mm. For the wire dot printer, the print time for one line is approximately 0.5 second, assuming that the print speed of the print head is 120 characters per second.

In the thermal printer of the present embodiment, the print speed of the thermal head is usually 5 ms/dot line.

Assuming that 36 dot lines are printed per line (which corresponds to printing dots at an interval of approximately 1/180 inch), the print time for one line by the thermal printer is equal to $5\times36=180$ ms, which is approximately 2.8 times faster than that of the wire dot printer. In the thermal printer of the present embodiment, since the pressure to the platen need not be released for each line feed operation as is required in the prior art wire dot printer, the performance is further improved over the wire dot printer. In the present embodiment, when printing on a first page and an adjacent second page is done serially, it is necessary to return the passbook to the initial print position in the course of printing and switch the thermal head. Such an operation is not required every time as seen from probability analysis of the print format. Also, the time required for such operation is not large enough to degrade the high speed printing feature of the thermal printer. In another embodiment to be described later, a higher speed printer which does not need to return the passbook to the initial print position will be explained.

As described above, the present embodiment uses the relatively low cost planar thermal head and attains high speed printing with high print quality.

Figure 7:
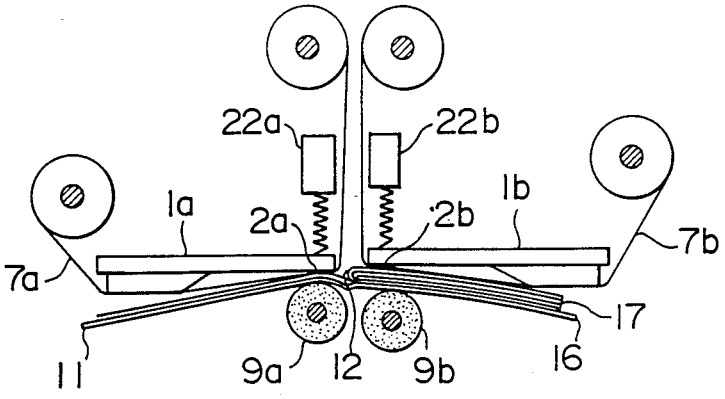
FIG. 7 is a sectional view for illustrating passbook printing in a second embodiment of the present invention.

Another embodiment of the present invention is described with reference to FIGS. 7 and 8. FIG. 7 shows a sectional view of the present embodiment. There are two major differences in construction from the previous embodiment.

First, two platen rollers 9a and 9b are provided one for each of the thermal heads 1a and 1b. Drive motors for driving the platen rollers 9a and 9b are not necessary in the present embodiment. The platen rollers 9a and 9b are located to face the heat generating resistors 2a and 2b of the thermal heads 1a and 1b. To this end, the diameter of the platen roller is smaller than 10 mm. Other construction is similar to that of the first embodiment.

Figure 8:
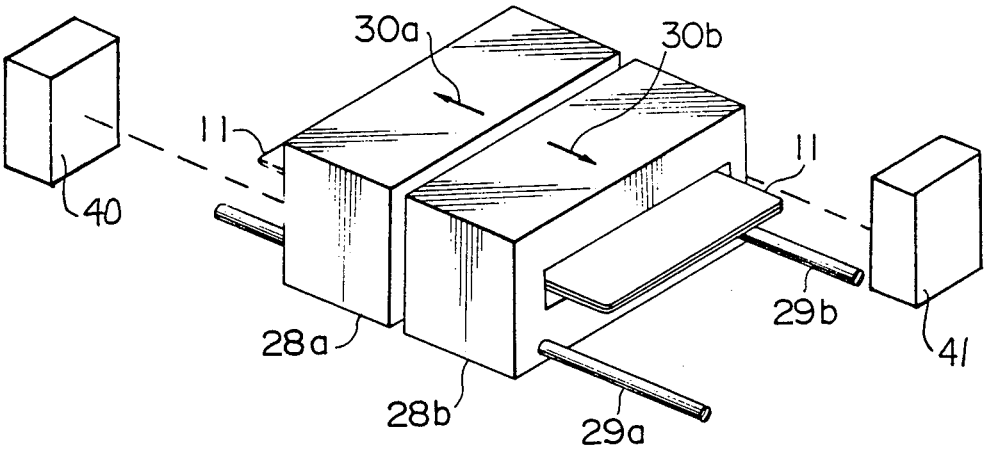
FIG. 8, is a perspective view of a carrier in the second embodiment.

Secondly, the two sets of print mechanisms are mounted on independent carriers 28a and 28b, respectively, as shown in FIG. 8. For each carrier, the shaft for mounting the platen roller in rotation can be fixed to the sides of the carrier. Similarly, the shafts for the pay-out and take-up rollers of the thermal carbon paper can extend between the carrier side walls. The independent spring and associated on/off mechanisms can be mounted within the carrier and be biased from the top wall of the carrier. The print head can also be fixed between opposing side walls of the carrier so that the booklet can be inserted in the carrier between the platen roller and the print head. The carriers are movable on support rails 29a and 29b. The carriers 28a and 28b are independently or simultaneously movable in directions 30a and 30b, respectively, by drive means such as motors 40 and 41 shown schematically. At the initial print positions of the carriers, the print positions of the thermal heads 1a and 1b are on the last print line 13a of a first page of the passbook 11 and on the first print line 13b of an adjacent page, respectively.

The operation of the present embodiment is explained. The two carriers 28a and 28b are positioned at the initial print positions and the pressure ON/OFF mechanisms 22a and 22b are released to create clearances between the thermal heads 1a, 1b and the platen rollers 9a, 9b. Under this condition, the passbook 11 is fed to the initial print position (feed means is omitted from the drawing), the pressure ON/OFF mechanisms 22a and 22b are activated to press the thermal heads 1a and 1b to the passbook 11. Then, the carriers 28a and 28b are independently moved in directions 30a and 30b and characters are printed in accordance with the principle of thermal transfer printing. In this case, the platen rollers 9a and 9b are pressed by the front sheet 16 of the passbook 11 to make idling rotation. Since the print sheets 17 of the passbook are bound along the folding line 12, they do not warp. In the present embodiment, characters can be simultaneously printed on the page 14 and the page 15 of the passbook 11 and hence a higher print speed is attained than in the previous embodiment.

In the above two embodiments, the passbook is folded along the horizontal folding line and the passbook is line-fed transversely to the print line. In the present invention, in addition to those embodiments, the passbook may be fed parallelly to the print line.

Figure 9:
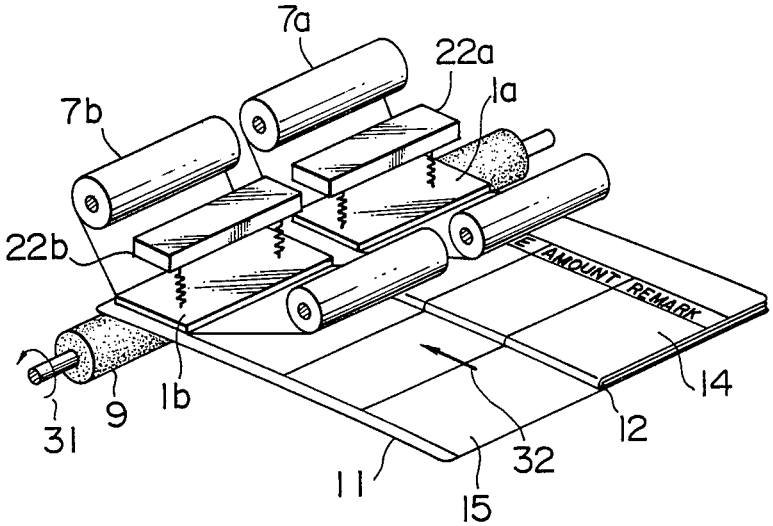
FIG. 9 is a perspective view for illustrating passbook printing in a third embodiment of the present invention.

FIG. 9 shows a perspective view of a third embodiment. Two thermal heads 1a and 1b, one for page 14 of the passbook and the other for page 15, are arranged transversely to the print line of the passbook 11. Two thermal carbon papers 7a and 7b and two pressure ON/OFF mechanisms 22a and 22b are independently arranged. The platen roller 9 is arranged to face the print positions of the thermal heads 1a and 1b. The two thermal heads 1a and 1b are spaced approximately 10 mm from each other. This area corresponds to a non-print area around the folding line 12 of the passbook 11.

The operation of the present embodiment is explained. The pressure ON/OFF mechanisms 22a and 22b are released to create clearances between the thermal heads 1a and 1b and the platen roller 9. Under this condition, the passbook 11 is fed (by roller mechanism, not shown) until the first character print position comes to the print position of the thermal head, and the pressure ON/OFF mechanisms 22a and 22b are actuated to press the thermal heads 1a and 1b to the passbook 11. Since the thermal heads 1a and 1b are spaced by approximately 10 mm as described above, the thermal heads do not contact the folding line 12 of the passbook 11. Further, since the two pressure ON/OFF mechanisms are independently, they can independently keep the respective thermal heads 1a and 1b in contact with the passbook 11 even if the thickness of the respective stacks of pages on opposite sides of folding line of the passbook 11 are different. Under this condition, the platen roller 9 is rotated by a motor in a direction 31 to move the passbook 11 in a direction 32, and characters are printed in accordance with the principle of thermal transfer printing. In the present embodiment, like in the first and second embodiments, the thermal heads are independently pressed to a first page and an adjacent page of the passbook, respectively, and no one thermal head is pressed to both pages. Therefore, it is not necessary to press the thermal head in a manner to significantly bend the passbook and the pressure may be relatively low. Accordingly, the print sheet does not warp and no crease is developed in the thermal carbon paper. Thus, a high print quality is attained. Another feature of the present embodiment as compared with the first and second embodiments is that the number of heat generating resistors of the thermal head may be small. In the two previous embodiments, as many heat generating resistors as the number corresponding to the width of the print line of the first page and the adjacent page of the passbook are required. In the present embodiment, the heat generating resistors of the thermal head need be arranged over the shorter length of the passbook along the line. Accordingly, the manufacturing cost of the thermal head is reduced and the drives of the thermal head can be simplified.

Figure 10:
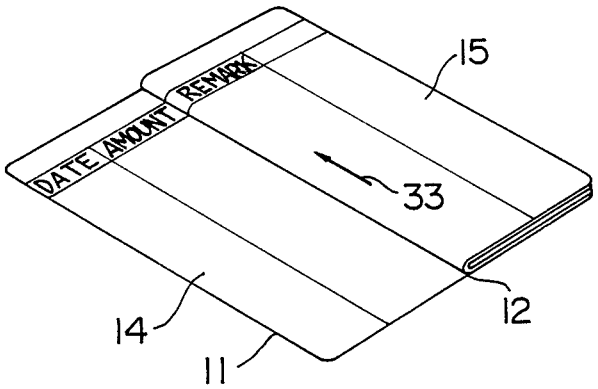
FIG. 10 shows a vertical fold type passbook which is a modification of the passbook.

In the above three embodiments, the horizontal fold type passbook was shown. Any of those embodiments can be applicable to a vertical fold type passbook as shown in FIG. 10. An example is shown with reference to FIGS. 9 and 10. FIG. 10 shows the vertical fold type passbook 11. This passbook 11 is fed in the direction 33 in the printer of FIG. 9 so that characters are printed in the same manner as that in the third embodiment.

The print format and the size of the passbook are different between the vertical fold type passbook and the horizontal fold type passbook. In the present invention, one printer can be selectively used for those two types of passbooks by an intervention of software for controlling the print operation.

In the above embodiments, the thermal printers are used. The present invention is applicable not only to the thermal printing system but also to a print system in which characters are printed by contact between the print element and the print sheet. Examples of other print system are electrostatic print system which uses an electrostatic record sheet as a print sheet, an electrograving print system which uses an electrograving sheet and an electrographic system. The present invention is applicable to those systems to provide high speed and high print quality passbook printers.

In accordance with the present invention, the high speed printing capability of the non-impact printer in which characters are printed by contact between the print element and the print sheet is not degraded, and the good contact between the print element and the print sheet is maintained even for the booklet which includes print areas of different thicknesses. Thus, the printer which can be constructed by the low cost point mechanism is provided.

I claim:

1. A booklet printer for printing characters on adjacent pages of a booklet having a plurality of sheets bound together along a seam line to form a seam line step between adjacent pages of the booklet comprising:

first line type print head means having a first edge and a plurality of non-impact type print elements aligned near said first edge for printing a line of characters on a first page of the adjacent pages of the booklet and for contacting only the first page without contacting the seam line step while maintaining a non-print area of the first page near the seam line step, said first line type print head means being a first print head;

second line type print head means having a second edge and a plurality of non-impact type print elements aligned along said second print head near said second edge for printing a line of characters on a second page of the adjacent pages of the booklet separated from the first page of the booklet by said seam line step formed along the booklet seam line and for contacting only the second page of the adjacent pages without contacting the seam line step while maintaining a non-print area of the second page near the seam line step, said second line type print head means being a second print head;

first press means for pressing said print elements of said first print head to said first page of the booklet during a printing operation of said first print head;

second press means for pressing said print elements of said second print head to said second page of the booklet during a printing operation of said second print head;

platen means arranged on the opposite side of the booklet in alignment with said first and second print heads to provide a surface against which said first and second print heads and the booklet are pressed; and drive means coupled to said platen means for driving said platen means to move the booklet in only one scanning direction at a time relative to said print heads so that one of the adjacent booklet pages is printed by printing the booklet in said only one scanning direction during the printing operation.

2. A booklet printer according to claim 1, wherein said first print head is spaced from said second print head a distance smaller than the combined distance of the non-print areas of each of the adjacent pages of the booklet such that said first and second print heads are spaced closely to one another.

3. A booklet printer according to claim 1, wherein said print elements of said first and second print heads are thermal recording print elements.

4. A booklet printer according to claim 3, further comprising:

first feed means for feeding a thermal carbon medium between the print elements of said first print head and the first page of the booklet; and second feed means for feeding a thermal carbon medium between the print elements of said second print head and the adjacent page of the booklet.

5. A booklet printer according to claim 1, wherein said first and second press means each includes spring means for biasing each associated one of said print heads toward said booklet, and a pressure ON/OFF mechanism coupled to said spring means for applying and releasing the pressure force exerted on each associated one of said print heads against said booklet.

6. A booklet printer according to claim 1, wherein only a selected one of said first and second print heads is operable at one time, and said platen means includes:

a single platen roller movable to face one of said first and second print heads; and switch means coupled to said platen roller for moving said platen roller toward said selected one of said print heads for the print operation.

7. A booklet printer according to claim 6, wherein said aligned print elements of said first and second print heads are substantially parallel to the seam line of said booklet, and the drive means move the booklet in said one scanning direction which is substantially normal to the seam line.

8. A booklet printer according to claim 7, wherein in a scan print operation of said first and second print heads, a position close to the seam line on the adjacent pages of said booklet is defined as a print scan start point, and a position close to a free edge of the adjacent pages of said booklet is defined as a print scan end point.

9. A booklet printer according to claim 1, wherein said platen means includes:

a first platen roller arranged to face said first print head and a second platen roller arranged to face said second print head.

10. A booklet printer according to claim 9, further comprising:

first carrier means movable relative to said booklet and carrying thereon said first print head, said first pressure means and said first platen roller;

second carrier means movable independently from said first carrier means relative to said booklet and carrying thereon said second print head, said second pressure means and said second platen roller; and guide means coupled to said first and second carrier means for independently moving said first and second carrier means parallel to the scanning directions of said first and second print heads.

11. A booklet printer according to claim 1, wherein said aligned print elements of said first and second print heads are substantially normal to the seam line step of said booklet, said platen means includes a platen roller arranged to face said aligned print elements and having a rotation axis parallel to said aligned print elements, and the drive means move the booklet in respective scanning directions which are substantially parallel to said seam line.

* * * * *